US006323780B1

(12) United States Patent
Morris

(10) Patent No.: US 6,323,780 B1
(45) **Date of Patent: *Nov. 27, 2001**

(54) COMMUNICATIVE ENVIRONMENTAL ALARM SYSTEM WITH VOICE INDICATION

(76) Inventor: Gary J. Morris, 2026 Glenmark Ave., Morgantown, WV (US) 26505

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/417,154

(22) Filed: Oct. 12, 1999

Related U.S. Application Data

(63) Continuation-in-part of application No. 09/299,483, filed on Apr. 26, 1999, now Pat. No. 6,144,310.

(60) Provisional application No. 60/104,217, filed on Oct. 14, 1998.

(51) Int. Cl.[7] ..... G08B 25/08

(52) U.S. Cl. ..... 340/692; 340/539; 340/577; 340/505; 340/506; 340/628; 340/632; 340/693.11

(58) Field of Search ..... 340/692, 539, 340/628, 632, 577, 693.11, 505, 506, 500, 517, 520–524, 531–534, 540, 584, 605, 691.1, 691.4, 693.5, 693.6, 693.7, 693.9, 286.01, 286.05, 286.11, 328, 329, 384.1, 384.3, 384.4, 384.73

(56) References Cited

U.S. PATENT DOCUMENTS

| | | | | |
|---|---|---|---|---|
| 3,906,491 | | 9/1975 | Gosswiller et al. . | |
| 4,101,872 | * | 7/1978 | Pappas | 340/539 |
| 4,141,007 | * | 2/1979 | Kavasilios et al. | 340/539 |
| 4,160,246 | | 7/1979 | Martin et al. . | |

(List continued on next page.)

FOREIGN PATENT DOCUMENTS

90/01759 2/1990 (WO) .

OTHER PUBLICATIONS

NFPA 72 National Fire Alarm Code 1996 Edition, 72–1 to 72–106 (partial copy); NFPA 720, Recommended Practice for the Installation of Household Carbon Monoxide (CO) Warning Equipment 1998 Edition.

UL 217 ISBN 0–7629–0062–8, Single and Multiple Station Smoke Alarms, Mar. 16, 1998–Feb. 21, 1997; UL 2034 ISBN 0–7629–274–9, Single and Multiple Station Carbon Monoxide Alarms, Dec. 21, 1998–Oct. 29, 1996.

*Primary Examiner*—Nina Tong
(74) *Attorney, Agent, or Firm*—Rockey, Milanow & Katz, Ltd.

(57) ABSTRACT

The battery powered or 120 VAC powered environmental condition detector of the present invention is designed to provide an early warning of the presence of an environmental condition (smoke or carbon monoxide gas or natural gas or propane gas or any multiple combination of these offending agents) to persons in remote areas of a building. The detector sensing the environmental condition emits an audible tonal pattern alarm, while transmitting a radio signal directly to other environmental condition detectors to activate their alarms and to activate an electronically stored human voice recording (or synthesized voice) that indicates the location of the environmental condition detector sensing the environmental condition, or the type of environmental condition, or both. Rechargeable light modules separate from the detector are included that receive the signal from the detector sensing the environmental condition and illuminate areas and paths of egress for the duration of the alarm condition or in case of 120 VAC power failure. All components of the system are easy to install due to the modular design and conventional power sources. An intermittent activation of the electronic circuitry in the detector unit may be used to conserve battery energy in the battery powered embodiment.

59 Claims, 7 Drawing Sheets

U.S. PATENT DOCUMENTS

| | | | | |
|---|---|---|---|---|
| 4,275,274 | | 6/1981 | English . | |
| 4,282,519 | | 8/1981 | Haglund et al. . | |
| 4,288,789 | | 9/1981 | Molinick et al. . | |
| 4,335,379 | | 6/1982 | Martin . | |
| 4,343,990 | | 8/1982 | Ueda . | |
| 4,350,860 | | 9/1982 | Ueda . | |
| 4,351,999 | | 9/1982 | Nagamoto et al. . | |
| 4,363,031 | * | 12/1982 | Reinowitz | 340/539 |
| 4,365,315 | | 12/1982 | Jamnik . | |
| 4,366,873 | | 1/1983 | Levy et al. . | |
| 4,375,329 | | 3/1983 | Park . | |
| 4,389,639 | | 6/1983 | Torii et al. . | |
| 4,400,786 | | 8/1983 | Mandei et al. . | |
| 4,453,222 | | 6/1984 | Goszyk . | |
| 4,455,551 | | 6/1984 | Lemelson . | |
| 4,481,507 | | 11/1984 | Takiguchi et al. . | |
| 4,498,078 | | 2/1985 | Yoshimura et al. . | |
| 4,500,971 | | 2/1985 | Futaki et al. . | |
| 4,519,027 | | 5/1985 | Vogelsberg . | |
| 4,531,114 | * | 7/1985 | Topol et al. | 340/539 |
| 4,560,978 | | 12/1985 | Lemelson . | |
| 4,572,652 | | 2/1986 | Tada et al. . | |
| 4,682,348 | | 7/1987 | Dawson et al. . | |
| 4,688,021 | * | 8/1987 | Buck et al. | 340/521 |
| 4,754,266 | | 6/1988 | Shand et al. . | |
| 4,810,996 | | 3/1989 | Glen et al. . | |
| 4,816,809 | | 3/1989 | Kim . | |
| 4,821,027 | | 4/1989 | Mallory et al. . | |
| 4,851,823 | | 7/1989 | Mori . | |
| 4,862,147 | | 8/1989 | Thomas . | |
| 4,894,642 | | 1/1990 | Ashbaugh et al. . | |
| 4,940,965 | | 7/1990 | Umehara . | |
| 4,988,980 | | 1/1991 | Graham . | |
| 5,019,805 | * | 5/1991 | Curl et al. | 340/628 |
| 5,103,206 | * | 4/1992 | Yu | 340/506 |
| 5,117,217 | | 5/1992 | Nykerk . | |
| 5,229,753 | | 7/1993 | Berg et al. . | |
| 5,291,183 | | 3/1994 | Chiang . | |
| 5,349,338 | | 9/1994 | Routman et al. . | |
| 5,379,028 | | 1/1995 | Chung . | |
| 5,460,228 | | 10/1995 | Butler . | |
| 5,506,565 | * | 4/1996 | De Leon et al. | 340/522 |
| 5,587,705 | | 12/1996 | Morris . | |
| 5,657,380 | | 8/1997 | Mozer . | |
| 5,663,714 | | 9/1997 | Fray . | |
| 5,673,023 | | 9/1997 | Smith . | |
| 5,724,020 | | 3/1998 | Hsu . | |
| 5,726,629 | | 3/1998 | Yu . | |
| 5,764,134 | | 6/1998 | Carr et al. . | |
| 5,786,749 | | 7/1998 | Johnson et al. . | |
| 5,786,768 | | 7/1998 | Chan et al. . | |
| 5,798,686 | | 8/1998 | Schreiner . | |
| 5,841,347 | | 11/1998 | Kim . | |
| 5,846,089 | | 12/1998 | Weiss et al. . | |
| 5,856,781 | | 1/1999 | Michel et al. . | |
| 5,864,288 | | 1/1999 | Hogan . | |
| 5,874,893 | | 2/1999 | Ford . | |
| 5,877,698 | | 3/1999 | Kusnier et al. . | |
| 5,886,631 | | 3/1999 | Ralph . | |
| 5,894,275 | | 4/1999 | Swingle . | |
| 5,898,369 | * | 4/1999 | Godwin | 340/539 |
| 5,914,650 | | 6/1999 | Segan . | |
| 5,936,515 | | 8/1999 | Right et al. . | |
| 5,986,540 | | 11/1999 | Nakagaki et al. . | |
| 6,114,967 | | 9/2000 | Yousif . | |
| 6,144,310 | | 11/2000 | Morris . | |
| 6,229,449 | | 5/2001 | Kirchner et al. . | |

* cited by examiner

COMMUNICATIVE ENVIRONMENTAL ALARM SYSTEM WITH VOICE INDICATION

This application claims the benefit of Provisional Patent Application No. 60/104,217, including Disclosure Document 415668, filed Oct. 14, 1998. This application is a continuation-in-part of U.S. Patent application entitled Environmental Condition Detector With Audible Alarm And Voice Identifier, Ser. No. 09/299,483, filed Apr. 26, 1999 now issued as Pat. No. 6,144,310.

FIELD OF THE INVENTION

The invention pertains to ambient condition detectors. More particularly, the invention pertains to such detectors which incorporate verbal outputs.

BACKGROUND OF THE INVENTION

Harmful agents such as smoke, carbon monoxide gas, natural gas, or propane gas may unknowingly exist for significant periods of time in areas of dwellings before the occupants are warned through conventional environmental condition detector systems. Even with a plurality of conventional detectors, occupants in remote locations of an involved dwelling may not be able to hear the local alarm horn, know where the problem exists, or know what type of problem has been detected based on the audible tonal alarm pattern alone.

A need exists for environmental condition detection systems that can effectively provide an early warning to dwelling occupants in remote locations or levels away from the source of the environmental condition and can provide a means for lighted areas and paths of egress while doing so in a cost effective and simple manner. Such a system should be easy to install and operate to encourage usage.

Environmental condition detectors designed for remote sensing are commonly electrically hardwired to a central annunciator/controller panel to indicate the location of the environmental condition within a building. Unfortunately, only some businesses and few residences are currently equipped with hardwired detection systems with centralized smoke/fire annunciator panels.

Installing and retrofitting of remote environmental condition detection systems within buildings and residences without centralized annunciator panels is greatly facilitated with the environmental condition detector system described herein. Such detectors can incorporate wireless, for example radio frequency, intercommunication capabilities, to verbally indicate the location of the detector which sensed the environmental condition in a remote location. The type of environmental condition detected can be verbally indicated. Areas and paths of egress can be illuminated all without the need for a central control unit.

SUMMARY OF THE INVENTION

An environmental condition detection system signals occupants of a building or residence through the combined use of an audible tonal pattern alarm and voice when a selected environmental condition, such as an alarm condition, is detected in the area of any of the detectors. In one embodiment, remotely controlled light modules illuminate paths of egress or other desired areas during the selected environmental condition.

The detectors can be stand alone units for smoke detection, carbon monoxide detection, natural gas detection, or propane gas detection. Alternately, multiple sensors can be incorporated into a combination unit.

In another embodiment, two or more wirelessly coupled detectors form a system. Additional detectors or light modules may be employed as needed for desired coverage.

If a selected environmental condition is sensed by any one detector, it emits an audible tonal pattern alarm and also emits an electronically recorded verbal message indicating that the environmental condition is in close proximity to the detector. The verbal message can, for example, state the type of alarm, fire, gas and/or location. Simultaneously, that detector transmits a preset coded, wireless signal to all other such detectors within the region or building tuned to the same said wireless code. This results in the remotely located detector units emitting an audible tonal alarm pattern and an electronically recorded human voice (or synthesized voice) to indicate where, elsewhere in the region or building, the environmental condition has been detected to serve as an early and descriptive warning for the occupants.

The voice recording is selectively indicative of the location of the environmental condition sensed or the type of environmental condition sensed, or both. This voice recording can be selected by the user.

As an option, the user can record a message into the electronic memory using a microphone for specific dwellings. For example, a smoke detector located on the second floor of a dwelling receiving a radio frequency signal from a smoke detector located in the basement of the same dwelling would, in one embodiment emit the smoke detector tonal pattern alarm and intermittently emit the voice saying "Basement", or "Smoke in Basement", "Fire" or similar messages, during periods of silence within the tonal pattern alarm.

In one aspect of the invention, a system includes two or more autonomous environmental condition detectors which directly, and wirelessly communicate with other like environmental condition detectors through a radio frequency link (or other wireless link) between units without the need for a centralized control unit. This provides flexibility in location selection, reduced risk of total system failure in the absence of a single centralized control unit, and ease of installation of the system.

In yet another aspect of the invention, wireless communication can be provided to remote light modules to illuminate paths of egress or to illuminate any other room or area desired by the system user for the duration of the sensing of an environmental condition. The light modules are, in one embodiment, 120 VAC rechargeable battery powered units designed to energize a lamp during a 120 VAC power failure or upon receiving a properly coded radio signal from any of the detectors which within radio signal range have sensed the environmental condition.

The light modules are intended to be plugged into standard wall mounted 120 VAC receptacles to provide illumination in close proximity to the floor (approximately 40 cm above the floor). These light modules may be fixed to the wall outlets with screw fasteners to prevent their removal or may be simply held in place by the outlet plug friction so that the light module may be removed and carried as an emergency flashlight during the environmental condition.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
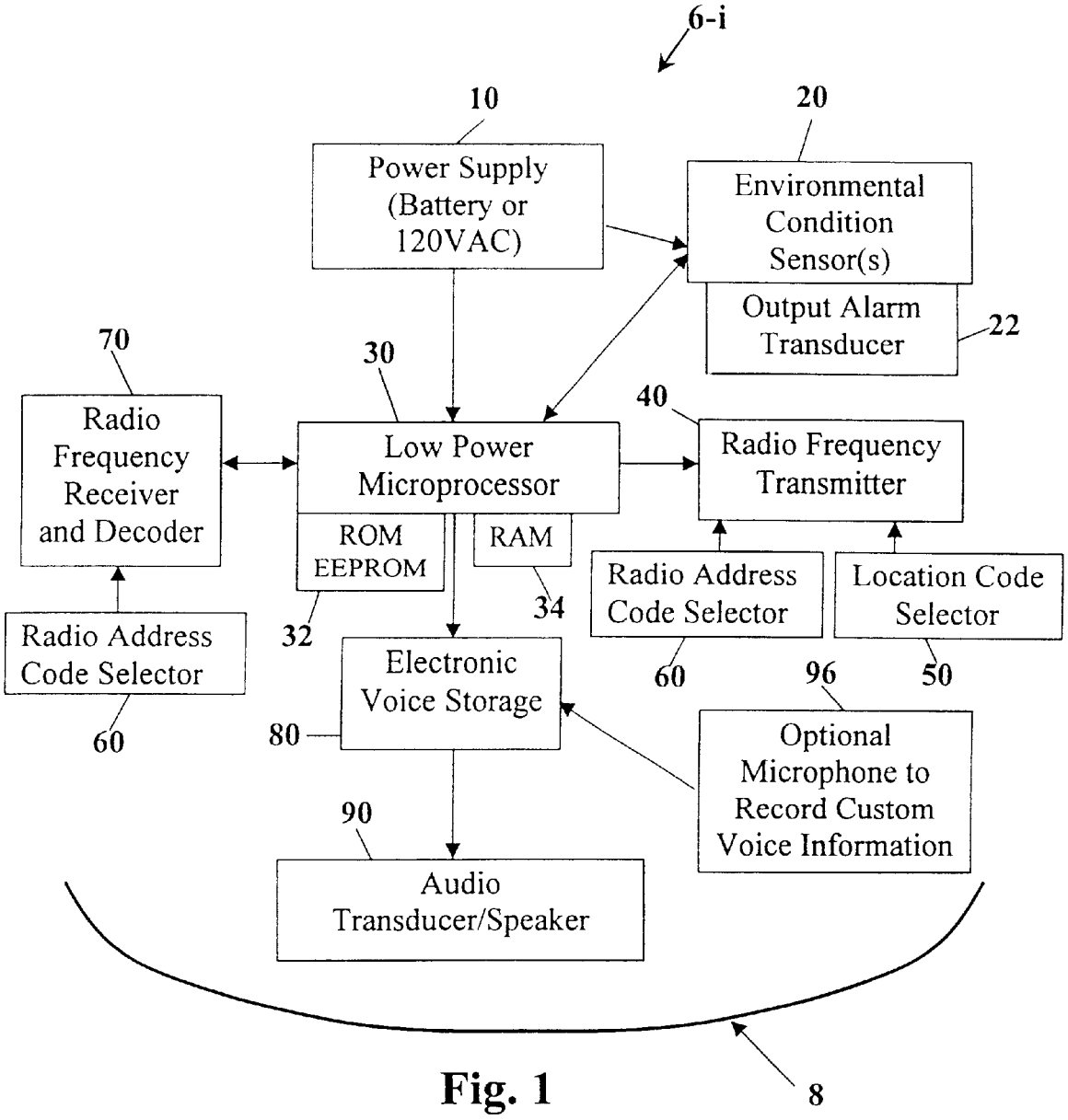
FIG. 1 is a block diagram of a detector with voice indication according to the invention.

While this invention is susceptible of embodiment in many different forms, specific embodiments are shown in the drawing and will be described herein in detail with the understanding that the present disclosure is to be considered as an exemplification of the principles of the invention and is not intended to limit the invention to the specific embodiments illustrated.

This application is a continuation-in-part of Ser. No. 09/299,483 filed Apr. 26, 1999. The specification and figures thereof are incorporated herein by reference.

A block diagram of a detector 6-i is illustrated in FIG. 1. Detector 6-i is contained within and carried by a housing 8.

Detector 6-i is powered, for example by a long life battery (alkaline or lithium, for example) 10. Alternately, a plug can be provided for coupling to standard 120 VAC. AC power with a battery back-up is an alternative.

An environmental condition sensor 20, for example a conventional smoke sensor, carbon monoxide sensor, natural gas sensor, or propane gas sensor, (or any multiple combination thereof) is any sensor type utilizing methods typically known in the art.

In one embodiment, sensor(s) 20 could each contain electronics (an ASIC for example) for purposes of making an alarm determination. For example, sensed smoke can be compared to a pre-selected threshold to establish the presence of a fire alarm condition. One or more values of sensed gas concentration can be processed to establish the presence of a gas alarm condition. In such a structure, upon sensing the alarm condition, the sensor 20 energizes an alarm unit 22 which sounds its local alarm to indicate that an environmental alarm condition has been sensed in proximity of the sensor 20.

In an alternate embodiment, processor 30, in conjunction with instructions prestored in ROM, PROM, EEPROM 32 or the like could be programmed to make an alarm determination. Random access memory 34 could also be coupled to processor 30 to provide temporary data storage. In this embodiment, processor 30 could select from one or more sets of tonal output patterns, stored in memory unit 32, and use a selected pre-stored set to drive output transducer 22. Types of storable patterns include a U.S. standard fire alarm pattern, a Canadian standard fire alarm pattern and one or more U.S. standard gas alarm patterns.

Figure 1A:
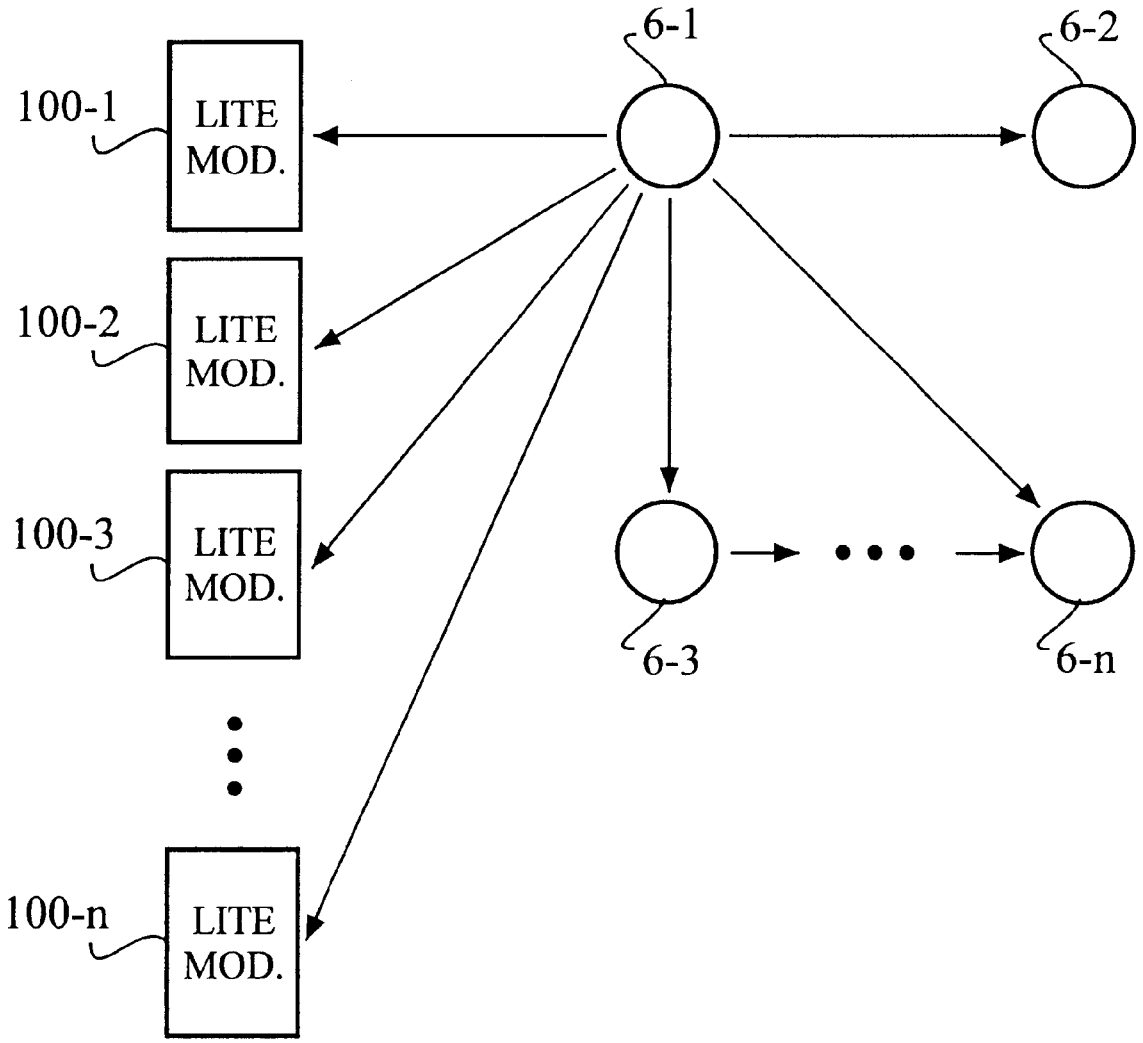
FIG. 1A illustrates a multi-detector system wherein the detectors communicate wirelessly directly with one another.

While the detector 6-i of FIG. 1 could be used as a stand alone unit, with or without the transmitter 40 and receiver 70, in an alternate embodiment, it can be one of a plurality of substantially identical detectors in a system. FIG. 1A illustrates a system which incorporates a plurality of detectors 6-1, 6-2 . . . 6-n all of which are substantially identical to the detector 6-i of FIG. 1.

In multi-detector systems, see FIG. 1A, the microprocessor 30 (in an active detector such as detector 6-1), signals a wireless transmitter 40 to transmit a coded, wireless signal defined by a location code selector 50 to all other detectors, 6-2, 6-3 . . . 6-n. At the same time, optional light modules 100-1 . . . 100-2 (FIG. 2) within receiving range can also be energized.

In the system of FIG. 1A, if one of the detectors goes into alarm, for example detector 6-1, in addition to sounding a local tonal alarm with an intervening verbal alarm identifying message, the active detector communicates wirelessly with other detectors 6-2 . . . 6-n in the range of transmitter 40. This communication is direct, detector-to-detector. This communication can be implemented by RF transmission, optical transmission, or sonic transmission without limitation. It will be understood that references to "Radio" as a form of wireless transmission in the figures is intended to be exemplary only and not limiting.

Each of the detectors 6-2 . . . 6-n which receives a wireless communication from a displaced detector such as detector 6-1, recognizes the alarm type and location of the originating detector given the contents of the received message. Hence, each of the receiving detectors can go into an appropriate alarm state and verbally provide location information and/or type information as to the source of the alarm. It will be understood that a detector, such as detector 6-3, in direct communication with active detector 6-1 could also relay a similar message to detector 6-n which might be out of direct range of the detector 6-1.

Additionally, the active detector, such as detector 6-1, can via the same transmission, activate a plurality of light modules 100-1 . . . 100-n corresponding to the light module 100-i of FIG. 2 and discussed subsequently. The activated light modules can provide a lighted escape pathway for an individual in the vicinity of the active detector 6-1 and can provide lighted regions in the vicinity of all light modules 100-1 . . . 100-n located within range.

As discussed below, each of the detectors 6-i can include a location code selector element and a radio address code selector element which is user settable. These user specifiable settings customize the behavior of an otherwise standard detector and provide advantageous flexibility.

The location code selector 50 is a user-set dip-switch/jumper arrangement that enables the user to define the location voice information that remote units will play upon receiving a signal from an alarmed detector that initially senses the environmental condition, such as a fire or a gas concentration. The location code selector 50 programs the transmitter 40 to transmit the coded signal.

By way of example, detectors located on the first floor of a dwelling may be set by the location code selector 50 to transmit a wireless signal to all other detectors instructing them to emit the audible tonal pattern alarm suitable for the detector type plus a voice playback indicating "First Floor" or "Smoke on First Floor", "Fire", "Fire First Floor" or the like, with periodicity.

Detectors located on the second floor of a dwelling may be set by the location code selector 50 to transmit a wireless signal to all other detectors instructing them to emit the audible tonal pattern alarm suitable for the detector type plus a voice playback indicating "Second Floor" or "Smoke on Second Floor" with periodicity. The voice messages are played during periods of silence in the audible tonal pattern alarm.

The address code selector 60 is a user-set switch that enables the user to select a coded wireless signal to be used for both transmission and reception, the intercommunication link between the detector units. This code is user-selectable to alleviate interference with spurious radio waves, optical waves or sonic waves and with other similar systems that may be operating in close proximity and are not desired to be operated within the same system.

Upon reception of a valid wireless signal, the receiver and decoder 70 decodes the signal according to the address code selector 60 setting. Upon verification that the received wireless signal originating from a desired transmitter, the receiver and decoder 70 then signals the microprocessor 30 to energize and drive the alarm unit 22 to sound its audible tonal alarm pattern.

Processor 30 also signals the electronic voice storage 80 to play or output the proper pre-stored voice information through the audio transducer/speaker 90 to verbally indicate the location of the detector sensing the environmental condition. An optional microphone 96 provides a means for the user to record short custom location information into the electronic voice storage 80.

It will be understood that a wide variety of electronic configurations for the detector 6-i come within the spirit and scope of the present invention. As noted previously, the detector 6-i can incorporate one or more different environmental condition sensors 20. For example, detector 6-i can incorporate a smoke sensor such an ionization-type smoke sensor or a photoelectric-type smoke sensor. In addition, that detector can incorporate a gas sensor, such a carbon monoxide sensor, a position sensor, a motion sensor or the like without limitation.

Various types of processing come within the spirit and scope of the detector 6-i. For example, processor 30 can detect signals from the sensors 20 carried by the detector 6-i, and, based on pre-stored executable instructions, make all necessary alarm decisions. This includes processing of signals from smoke sensors and/or processing of signals from gas sensors, thermal sensors and the like. Alternately, one or more of the sensors 20 can be coupled to an application specific integrated circuit (ASIC) which can carry out processing specific to that type of sensor. Output from the ASIC can in turn be coupled to the processor 30 if desired.

Further, it will be understood that the alarm output transducer 22 and the audio transducer 90 can be separate elements or they can be integrated into a single unitary output transducer without departing from the spirit and scope of the present invention. Processor 30 can be augmented, or replaced, with hard wired circuits as desired within the spirit and scope of the present invention.

Figure 2:
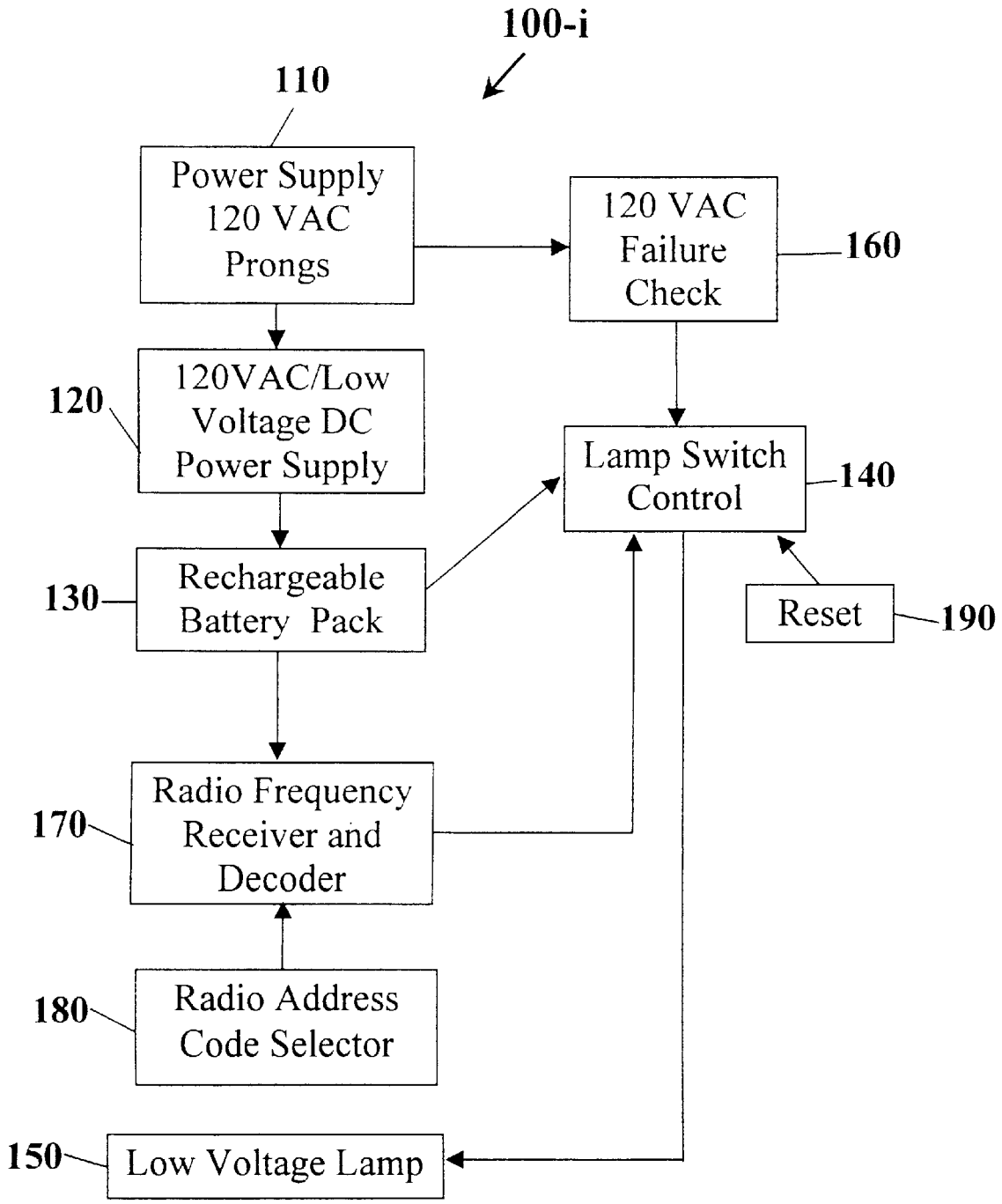
FIG. 2 is a block diagram of a light module usable in conjunction with the preferred embodiment of the detector diagram shown in FIG. 1.

An output light module 100-i is illustrated in FIG. 2. The module 100-i is intended to be coupled to a 120 VAC electrical outlet by prongs 110. Received AC powers a 120 VAC to low-voltage DC electrical power supply 120. The low-voltage DC electrical power supply 120 maintains a rechargeable battery pack 130 in a state of full charge.

An internal lamp switch control 140 energizes a low-voltage lamp 150 during a 120 VAC power failure as determined by a 120 VAC power failure circuit 160 or by reception of a properly coded wireless signal by the receiver and decoder 170. This signal will have been transmitted from a detector unit that has sensed an environmental alarm condition.

The receiver and decoder 170 is continuously active and is powered by the power supply 120 through the battery pack 130 when 120 VAC power 110 is available or by the battery pack 130 upon 120 VAC power failure. The receiver and decoder 170 interprets the wireless signals received as programmed by the user-selectable address code selector 180. The address code selector 180 is set to the same address code as the address code selector 70 in FIG. 1 if the light module 100-i is to be part of the same system, see FIG. 1A.

Upon reception of a valid wireless signal from a detector that has sensed an environmental alarm condition, the receiver and decoder 170 signals the internal electronic switch 140 to energize the low-voltage lamp 150.

The low-voltage lamp 150 is powered from the power supply 120 as long as the 120 VAC power supply 110 is functioning. Otherwise, the low-voltage lamp 150 is powered by the rechargeable battery pack 130.

Once activated by reception of a valid wireless signal, the low-voltage lamp 150 remains energized at least until no further valid wireless signals are received. If desired, a manual reset can be provided by a user operating the reset switch 190. When the low-voltage lamp 150 is energized due to a 120 VAC supply failure, it remains energized until the 120 VAC power supply is reactivated or the energy of the battery pack 130 is expended.

In addition, other types of receiving units are within the spirit and scope of the present invention. One alternate type of receiving unit is a wirelessly coupled fire extinguisher.

Figure 3:
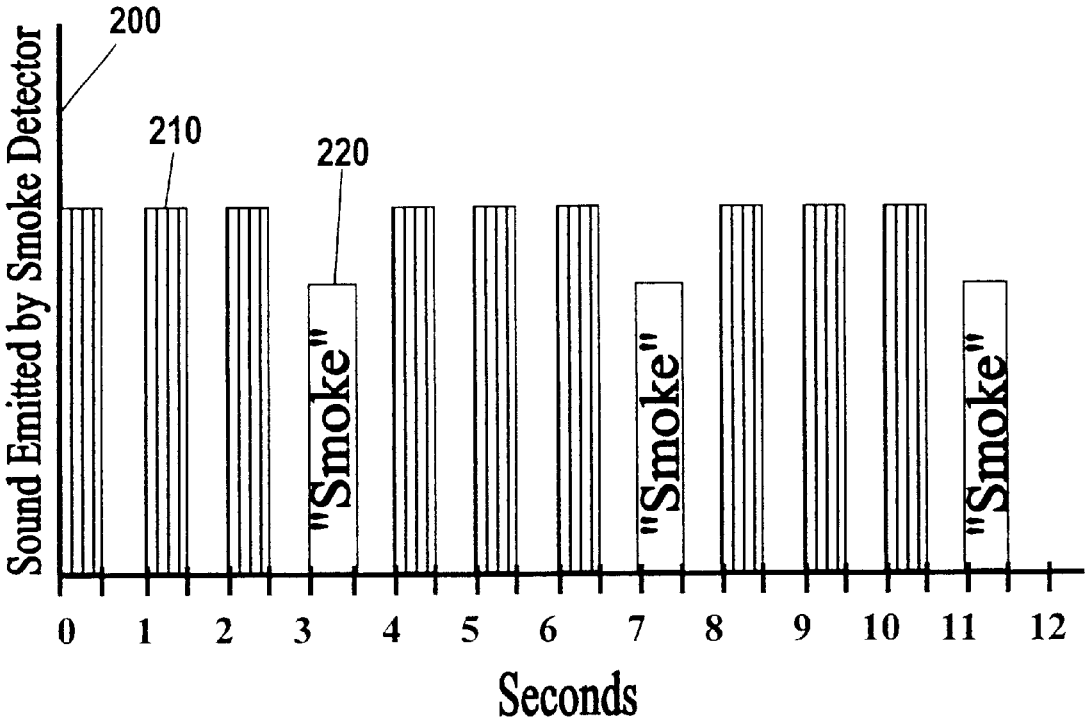
FIG. 3 illustrates an exemplary audible tonal pattern alarm and recorded voice message combination emitted by the detector of FIG. 1 when configured as a fire detector and using a recorded voice message as an environmental condition type identifier.

FIG. 3 is an exemplary smoke alarm timing plot 200 of the sound emitted by an alarmed detector 6-i which incorporates a smoke sensor. In the output pattern of FIG. 3, both an audible tonal pattern alarm 210 and a recorded voice message 220 convey information about the specific environmental condition detected.

In FIG. 3, the detector embodiment is a fire detector implemented as a smoke detector using voice as an environmental condition type identifier only. The recorded voice message 220 is inserted into the defined silence periods of the prescribed audible tonal pattern alarm 210 consistent with conventional smoke detector alarms.

Other messages identifying alarm type could be used. For example, instead of "Smoke", the detector could verbalize "Fire" or "Fire Fire". In the example of FIG. 3, groups of three spaced apart 0.5 second fire alarm tones, generated by output transducer 22 (FIG. 1), are spaced apart by 1.5 second silent intervals. The verbal alarm message 220 is output repetitiously during the 1.5 second silence interval. The verbal messages specify and can reinforce the type of alarm. Other tone patterns and silent intervals come within the spirit and scope of the present invention.

Figure 4:
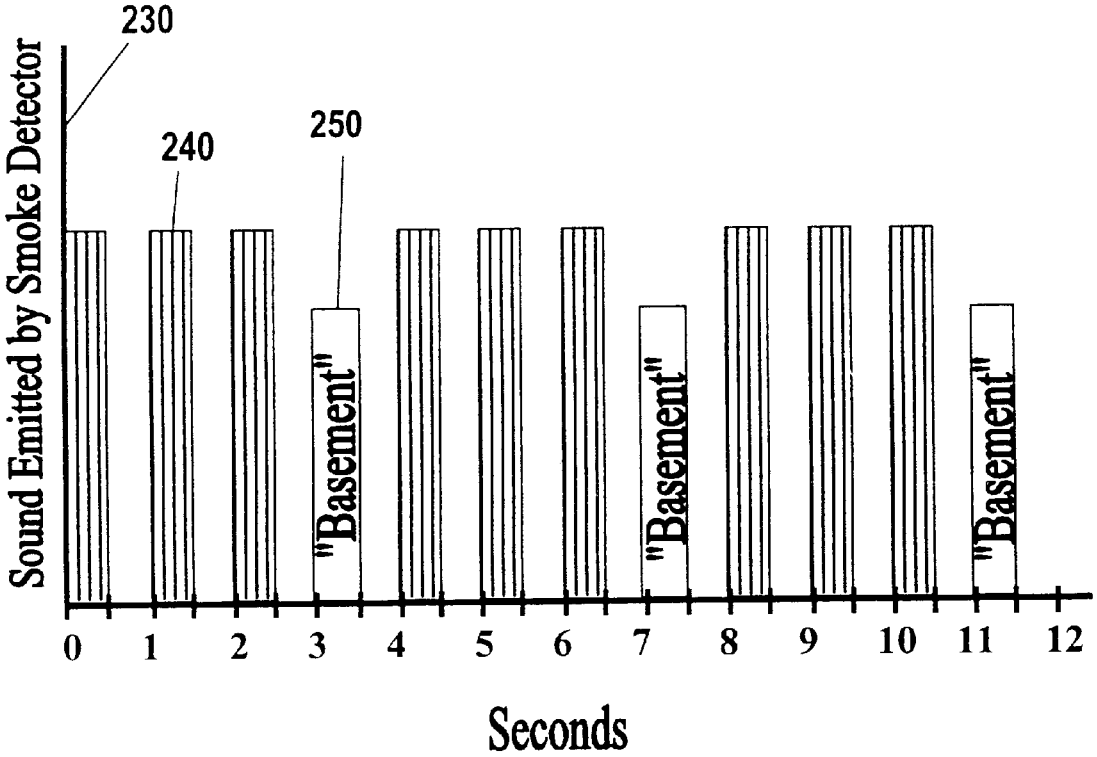
FIG. 4 illustrates an exemplary audible tonal pattern alarm and recorded voice message combination emitted by the detector of FIG. 1 when configured as a fire detector using a recorded voice message as an environmental condition location identifier.

FIG. 4 illustrates an exemplary alarm timing plot of the sound 230 emitted by a smoke detector using an audible tonal pattern alarm 240 to convey a smoke alarm and a recorded voice message 250 to convey the location of the detected fire and smoke. In FIG. 4, the environmental condition detector embodiment is a smoke detector using voice as an environmental condition location identifier only. The recorded voice message 250 is inserted into the defined silence periods of the prescribed audible tonal pattern alarm 240 consistent with conventional smoke detector alarms.

Figure 5:
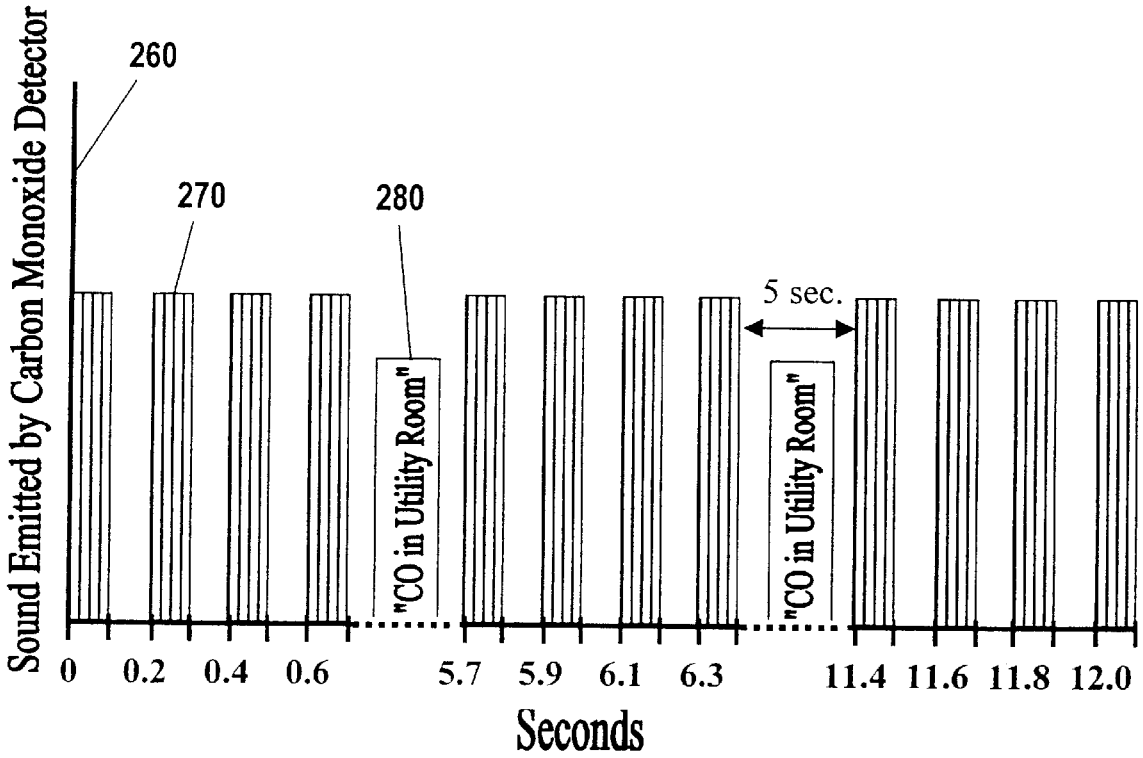
FIG. 5 illustrates an exemplary audible tonal pattern alarm and recorded voice message combination emitted by the detector of FIG. 1 when configured as a carbon monoxide detector using a recorded voice message as an environmental condition type identifier.

FIG. 5 illustrates an exemplary alarm timing plot of sound 260 emitted by a detector such as detector 6-i (FIG. 1) with a CO sensor. An audible tonal pattern alarm 270 indicative of detected carbon monoxide and a recorded voice message 280 convey the specific type of environmental condition, carbon monoxide and the location of the alarmed detector sensing the dangerous levels of carbon monoxide.

In FIG. 5, the environmental condition detector embodiment is a carbon monoxide detector using voice as both an environmental condition type identifier and location identifier. The recorded voice message 280 is inserted into the defined silence periods of the prescribed audible tonal pattern alarm 270 consistent with conventional carbon monoxide alarms.

Figure 6:
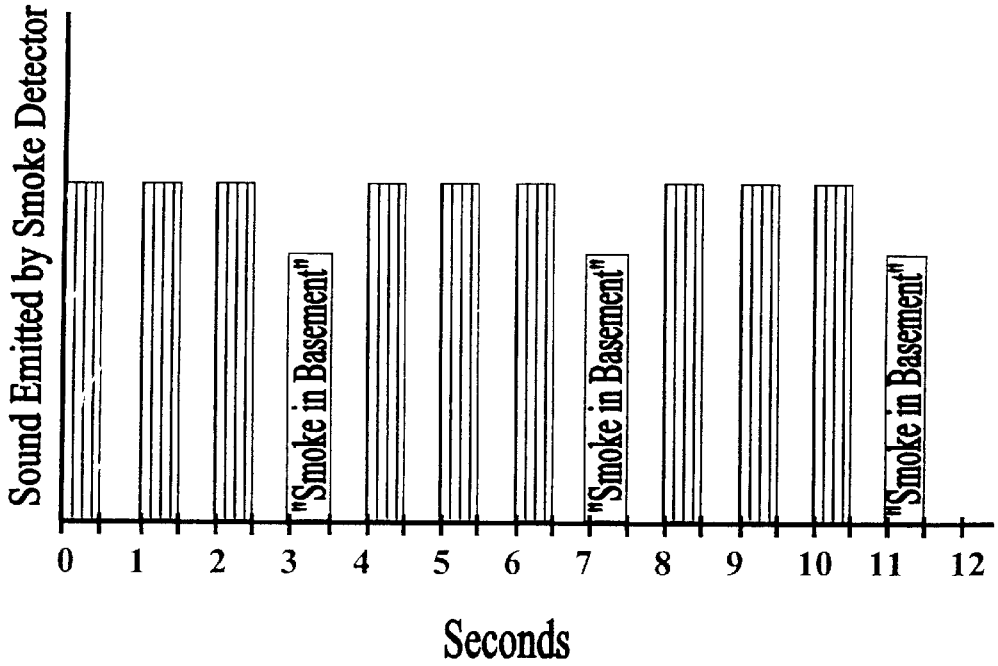
FIG. 6 illustrates an alternate verbal message emittable by a fire or smoke detector as in FIG. 1.
Figure 7:
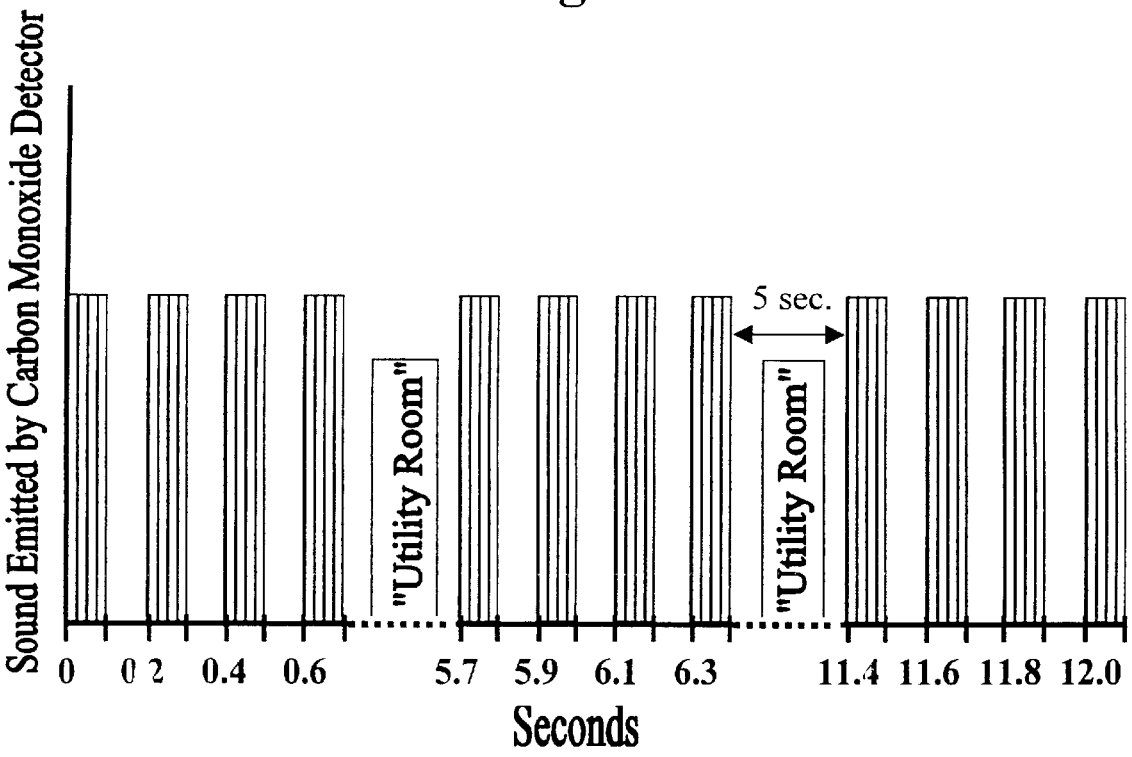
FIG. 7 illustrates an alternate verbal message emittable by a gas detector as in FIG. 1.

FIG. 6 illustrates a tonal/verbal smoke detector output with an alternate verbal message. FIG. 7 illustrates a tonal/verbal carbon monoxide detector output with an alternate verbal message. The exemplary tonal pattern alarms and recorded voice messages are illustrative and not intended to exhaustively illustrate all possible tonal alarm patterns and recorded voice messages.

Figure 8:
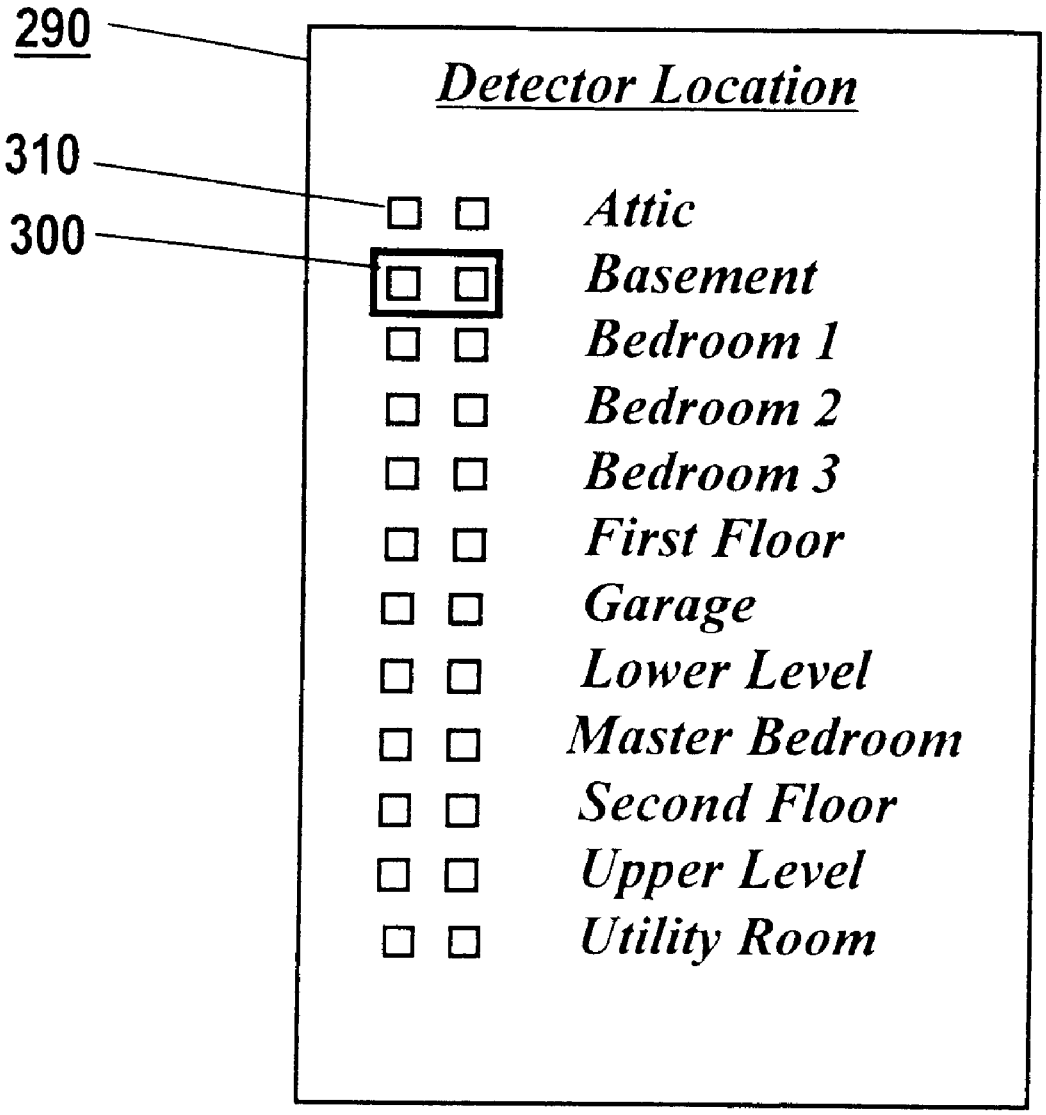
FIG. 8 illustrates one method for the user to specify the installation location of the detector of FIG. 1.

FIG. 8 illustrates a selectable coding apparatus 290, corresponding to selector 50 for the user to select one of the pre-defined locations when the detector 6-i (FIG. 1) has been installed in a dwelling. Selectable coding elements such as a jumper 300 on DIP header pins 310 or DIP switches (not shown) are alternate methods to define the installation location of a detector. Typical dwelling locations are shown in FIG. 6. The list of FIG. 6 is not intended to be exhaustive. Alternate mechanisms for specifying location also come within the spirit and scope of the present invention.

In summary, in one embodiment, the present inventive wireless communicative environmental alarm system with voice indication for indicating an alarm condition due to the presence of smoke, carbon monoxide gas, natural gas, propane gas or any multiple combination of these offending agents includes one or more sensors for indicating the presence of the selected environmental conditions wherein the sensor(s) is/are any known type. Actuation of an output transducer generates an audible tonal alarm pattern with voice for the duration of the environmental condition.

Wireless direct communication between detectors utilizes user-selectable, coded, signal transmission. The detectors can include a user-selectable, coded wireless transmitter and receiver.

The communication signal can be coded to verbally indicate the location within the dwelling of the detector that has sensed the respective environmental condition(s) by preset switches or manually settable elements for the user to manually select the verbal information indicative of each environmental condition detector location to be emitted. This selected information will be verbally emitted by all environmental condition detectors that receive the coded wireless signal transmission from the detector that has gone into alarm.

Circuitry is included for conservation of battery energy through intermittent activation of the wireless receiving circuitry. Low power electronic circuitry is included to control the activation intermittency of the receiving circuitry.

Test circuits for electronically simulating an environmental condition within the respective detector include a test switch accessible to the user operating the test switch activates the local audible alarm and initiates a wireless transmission to all other environmental condition detector units with an embedded code indicative of the location of the detector under test to determine operability of components therein.

Verbal information regarding the location of the sensed environmental condition, the type of the sensed environmental condition, or both, is emitted during silent periods within the audible tonal pattern alarm emitted by the active detector during an alarm condition. Multiple tonal patterns can be stored in detector memory.

The invention also pertains to a low voltage direct current, rechargeable light module to illuminate areas of a dwelling and paths of egress from a dwelling during an alarm condition. Exemplary modules include connectors for direct connection to a 120 VAC power supply wall outlet or the like; circuitry for conversion of 120 VAC power to a low voltage direct current, and a source of illumination wherein the illumination source includes, for example, a low voltage lamp.

The module may include circuitry by which to energize the low voltage lamp upon failure of 120 VAC power supply; or upon reception of a coded wireless signal from a detector's transmission. Circuitry is included for reception and decoding of the received wireless signal wherein a user can select the code for decoding. The system may also include a facility for manually de-energizing the lamp, such as a reset switch, accessible to the user.

It will be understood that in instances where a detector includes two or more sensors that it will include multiple tonal alarms and verbal messages, one set for each sensor. Similarly, multiple coded messages specifying alarm type, associated with each respective sensor, can be wirelessly transmitted to other detectors.

Output transducers, such as transducer 22, can include loud speakers or piezoelectric elements. Transducer 90 can include loud speakers.

The various preferred embodiments described above are merely descriptive of the present invention and are in no way intended to limit the scope of the invention. Modifications of the present invention will become obvious to those skilled in the art in light of the detailed description above, and such modifications are intended to fall within the scope of the appended claims.

What is claimed:

1. An environmental condition detection system having:

a minimum of two environmental condition detectors, each said environmental condition detector comprising (a) at least one sensor for detecting the presence of a selected environmental condition, (b) an audible alarm having at least one user unalterable, prescribed audible tonal pattern active in response to sensing said environmental condition in accordance with a predetermined criterion;

(c) voice circuitry for playing at least one user unalterable, pre-recorded voice message wherein the message verbally describes the type of detected environmental condition for the duration of detection thereof in accordance with said criterion such that said pre-recorded voice message is emitted during periods of silence in said prescribed audible tonal pattern alarm; and (d) a transmitter and a receiver for wireless direct communication with other detectors of the system wherein each transmitter transmits coded wireless signals and each said receiver responds to received, coded signals, each said detector emitting at least one user unalterable electronically pre-recorded voice message, the selection of which is defined by electronic decoding of the received wireless signal transmitted by a condition detector sensing said environmental condition;

(e) selectable coding circuitry to define the installation location of the respective detector and wherein the voice circuitry plays a location specifying message;

wherein said at least one sensor is selected from a group including a smoke sensor, a carbon monoxide gas sensor, a natural gas sensor, and a propane gas sensor.

2. The system of claim 1 wherein at least some of the detectors include at least a second sensor of a different type and wherein the voice circuitry therein plays a second user unalterable pre-recorded voice message which describes a second type of detected environmental condition such that the pre-recorded voice is emitted during periods of silence in a prescribed audible tonal pattern.

3. The system of claim 1 further comprising a light module to illuminate adjacent areas during the detection of said environmental condition, said a light module comprising a lamp, an element for a plug-in type connection of the module to a power supply, a rechargeable battery for powering said light module upon a power failure, a control circuit and a wireless receiver, said circuit causing said lamp to be energized by upon receipt of a selected coded wireless signal by the receiver.

4. The system of claim 1 wherein said voice circuitry for playing said pre-recorded voice messages has further circuitry to provide for the selection of language type presentation of said pre-recorded voice messages.

5. The system of claim 1 wherein said audible alarm comprises storage for multiple tonal alarm patterns.

6. The system of claim 5 which includes a processor programmed for retrieving a selected tonal alarm pattern and presenting same to the audible alarm.

7. A system as in claim 1 wherein the type of wireless communication is selected from a class which includes acoustic transmission, optical transmission and radio frequency transmission.

8. A system as in claim 1 which includes at least one light module having:

a wireless receiver;

control circuitry coupled to the receiver; and a source of illumination coupled to the control circuitry wherein the control circuitry energizes the source in response to receipt of a selected wireless signal.

9. A system as in claim 8 which includes a power supply.

10. A system as in claim 9 wherein the supply comprises a battery.

11. A system as in claim 9 wherein the supply includes a connector for engaging an exterior source of energy.

12. An environmental condition detection system comprising:

a minimum of two environmental condition detectors, each said environmental condition detector comprising (a) at least one sensor for detecting the presence of a selected environmental condition, (b) an audible alarm having at least one user unalterable prescribed audible tonal pattern active in response to sensing said environmental condition in accordance with a predetermined parameter;

(c) circuitry for playing at least one user unalterable pre-recorded voice message wherein the message verbally describes the location of the detected environmental condition for the duration of detection thereof in accordance with the parameter such that said pre-recorded voice message is emitted during selected periods of silence in said prescribed audible tonal pattern alarm;

(d) a transmitter and a receiver for wireless direct communication with other detectors of the system wherein each transmitter transmits coded wireless signals and each said receiver responds to received, coded signals, each said detector emitting at least one user unalterable electronically pre-recorded voice message, the selection of which is defined by electronic decoding of the received wireless signal transmitted by a detector sensing said environmental condition; and (e) wherein said circuitry for playing said pre-recorded voice messages has a second circuit to provide for the selection of language-type presentation of said pre-recorded voice messages.

13. The system as in claim 12 wherein the circuitry plays a user unalterable. condition specifying message during other periods of silence.

14. The system of claim 13 wherein at least some of the detectors include at least a second sensor of a different type and wherein the circuitry therein plays a second, user unalterable condition specifying pre-recorded voice message such that the pre-recorded voice is emitted during periods of silence in a prescribed audible tonal pattern.

15. The system of claim 14 wherein said audible alarm comprises storage for multiple tonal alarm patterns.

16. The system of claim 15 which includes a processor programmed for retrieving a selected tonal alarm pattern and presenting same to the audible alarm.

17. The system of claim 12 wherein said sensors are selected from a group including a smoke sensor, a carbon monoxide gas sensor, a natural gas sensor, and a propane gas sensor.

18. The system of claim 12 further comprising a light module to illuminate adjacent areas during the detection of said environmental condition, said a light module comprising a lamp, an element for a plug-in type connection of the module to a power supply, a rechargeable battery for powering said light module upon a power failure, a control circuit and a wireless receiver, said circuit causing said lamp to be energized by upon receipt of a selected coded wireless signal by the receiver.

19. A system as in claim 12 wherein the type of wireless communication is selected from a class which includes acoustic transmission, optical transmission and radio frequency transmission.

20. A system as in claim 12 which includes at least one light module having:

a wireless receiver;

control circuitry coupled to the receiver; and a source of illumination coupled to the control circuitry wherein the control circuitry energizes the source in response to receipt of a selected wireless signal.

21. A system as in claim 20 which includes a power supply.

22. A system as in claim 21 wherein the supply includes at least one prong for engaging an exterior source.

23. A method for providing environmental condition detection for a multi-section region comprising:

(a) locating a minimum of two environmental condition detectors in different sections of the region;

(b) setting a selectable coding element in each detector to define the location of the respective detector within a section;

(c) sensing an environmental condition and playing a user unalterable pre-recorded voice message, which verbally describes at least the location of the sensed condition;

(d) communicating wirelessly with another, selected detector such that the pre-recorded voice message at the sensed location is also emitted at the another detector.

24. A method as in claim 23 which includes verbally stating a type of sensed condition.

25. A method as in claim 23 which includes:

selecting the wireless communication from a class which includes acoustic communication, optical communication radio-type communication.

26. A method as in claim 23 which includes:

communicating wirelessly with a displaced source of illumination; and energizing the source in response to receipt of a selected communication.

27. A detector comprising:

a) at least one sensor for sensing the presence of an environmental condition, wherein said sensor is selected from a group including a smoke sensor, a carbon monoxide gas sensor, a natural gas sensor, and a propane gas sensor and wherein said sensor further includes at least a second, different sensor, b) a transmitter for transmitting a radio frequency signal, c) a selector to define a coded radio frequency signal to be transmitted by said transmitter, d) a receiver for radio signal reception, e) an alarm code selector to define a voice information code to be transmitted in said radio signal, and f) an audio transducer that emits selected user unalterable voice information in response to the receiver receiving a selected radio signal transmitted by another transmitter.

28. A detector as in claim 27 which includes circuitry for storage of at least one user unalterable alarm type voice message.

29. A detector as in claim 28 which includes circuitry for storage of a second, location specifying voice message.

30. A self-contained ambient condition detector comprising:

a housing;

at least one ambient condition sensor carried by the housing;

a control element, carried by the housing and coupled to the sensor, for establishing the presence of a selected alarm condition;

a wireless receiver coupled to the control element wherein the receiver and control element receive and decode wireless messages transmitted by other detectors;

a manually settable location specifying member, coupled to the control element whereby a user can specify a location at which the housing is installed;

voice annunciating circuitry and a plurality of stored user unalterable verbal outputs with one output identifying, at least in part, an alarm type and at least one output identifying, at least in part, an alarm location wherein in response to a received wireless message from another detector, the voice annunciation circuitry outputs at least one of a verbal alarm type and a verbal alarm location; and a wireless transmitter, coupled to the control element whereby the control element includes circuitry for formatting wireless alarm specifying messages for transmission to displaced, substantially identical, detectors whereby the receiving detectors receive the alarm specifying messages for verbal presentation thereat;

wherein transmitted messages include location information as specified by the manually settable member.

31. A detector as in claim 30 wherein the at least one sensor is selected from a class which includes a position sensor, a motion sensor, a breakage sensor, a gas sensor, and a fire sensor.

32. A detector as in claim 30 which includes a second, different, sensor wherein the sensors are selected from a class which includes a gas sensor, a smoke sensor and a thermal sensor.

33. A detector as in claim 30 wherein the control element comprises a programmed processor and associated storage unit which includes at least one prestored audible alarm indicating tonal output pattern.

34. A detector as in claim 33 which includes a plurality of tonal output patterns pre-stored in the unit wherein one of the patterns is a fire alarm pattern.

35. A detector as in claim 34 wherein another of the prestored patterns is a gas alarm pattern.

36. A detector as in claim 30 wherein the control element comprises a storage unit for digitally storing at least one alarm indicating tonal output pattern.

37. A detector as in claim 30 wherein the annunciating circuitry comprises a speech synthesizer.

38. A detector as in claim 30 which includes a tonal output device coupled to the control element wherein the control element in response to the presence of the selected alarm condition, drives the output device to emit pluralities of alarm specifying output tones wherein the pluralities are temporally spaced apart from one another a selected interval and wherein the voice annunciating circuitry outputs at least one of the verbal alarm type and the verbal alarm location during the selected intervals.

39. A detector as in claim 38 wherein the pluralities of output tones are user unalterable.

40. A detector as in claim 39 wherein in response to the received wireless message, the voice annunciation circuitry outputs at least one of the verbal alarm type and the verbal alarm location during the selected intervals.

41. An alarm system comprising:

a plurality of wirelessly coupled, self-contained detectors wherein each detector includes a transceiver for wireless transmission of and reception of coded messages, directly communicated between detectors, wherein the messages include at least alarm specifying information transmitted by a detector exhibiting an alarm condition; and wherein at least some detectors include voice output circuitry for verbally broadcasting user unalterable messages identifying the existence of an alarm condition at a different detector in response to a coded message directly received therefrom;

wherein at least some of the detectors include manually settable location specifying circuitry and the transmitted messages therefrom include both alarm and location information;

wherein the voice output circuitry of at least some of the detectors verbally outputs both alarm and location information received from another detector.

42. A system as in claim 41 wherein at least some of the detectors include at least one ambient condition sensor selected from a class which includes at least a fire sensor, a gas sensor, a position sensor, a motion sensor and a breakage sensor.

43. A system as in claim 42 wherein the fire sensors comprise one or more of a thermal sensor, a photoelectric smoke sensor and an ionization smoke sensor.

44. A system as in claim 41 wherein at least some of the detectors include an alarm indicating audible output transducer.

45. A system as in claim 44 wherein at least some of the transducers comprise piezoelectric transducers.

46. A system as in claim 44 wherein verbal alarm specifying messages are interleaved with user unalterable tonal alarm indicating messages.

47. A system as in claim 46 wherein verbal alarm location messages are interleaved with tonal alarm indicating messages.

48. A system comprising:

at least one detector wherein the detector includes an ambient condition sensor and control circuitry for detecting the presence of a selected ambient condition and for emitting a user unalterable, patterned tonal alarm indicative of the detected condition wherein groups of tones are spaced apart by a first interval and tones in a group are spaced apart by a second, shorter, interval;

a transmitter coupled to the control circuitry for wirelessly emitting a condition specifying control signal to at least one displaced illumination module wherein the module comprises at least one prong for releasibly coupling to an external source of power, a receiver for receipt of the condition specifying control signal, a light source and circuitry for illuminating the source in response to receipt of the condition specifying control signal; and voice annunciating circuitry for playing at least one, user unalterable, pre-recorded voice message during the first intervals wherein the message specifies the type of condition and wherein the voice annunciating circuitry is located at least in part at the detector;

a settable location specifying element coupled to the control circuit and wherein the annunciating circuitry verbally introduces a location specifying message, in accordance with a setting of the location specifying element, into some of the first intervals which would otherwise be silent;

a second detector, substantially identical to the at least one detector wherein the detectors can both be in wireless communication with the module.

49. A system as in claim 48 wherein the detectors each include a manually changeable, system specifying code incorporated into the condition specifying control signal.

50. A system as in claim 49 wherein the module includes circuitry for establishing the presence of a predetermined system specifying code in a received condition specifying control signal.

51. A system as in claim 50 wherein the module includes a manually changeable, system specifying code.

52. A system as in claim 48 wherein the module includes a battery.

53. A system as in claim 48 wherein the verbal type specifying message and the location specifying message are stored at the at least one detector.

54. An electrical unit comprising:

at least one of a condition sensor and source of illumination;

a control circuit responsive to a selected ambient condition to produce at least one output signal indicative thereof;

an audible output device, coupled to the control circuit and drivable thereby in response to the selected condition, to produce groups of user unalterable, alarm-type indicating tones wherein groups of tones are spaced apart a first interval and wherein tones in a group are spaced apart from one another a second, shorter interval;

voice output circuitry, coupled to the control circuit and driven thereby to produce at least one user unalterable alarm specifying output message which verbally identifies the same alarm as does the tonal output pattern wherein the output message is injected into at least some of the first intervals between tonal groups;

a settable system specifying element coupled to the control circuit for establishing a coded system specific identifier; and at least one of a transmitter and a receiver coupled to the control circuitry to respectively send or receive a wireless signal indicative of the condition wherein sent signals include a system identifier and wherein received signals include a system identifier.

55. An electrical unit as in claim 54 wherein the sensor and the transmitter are coupled to the control circuit.

56. An electrical unit as in claim 54 wherein the source and the receiver are coupled to the control circuit.

57. An electrical unit as in claim 54 wherein the control circuit includes a programmed processor and wherein instructions for implementing at least the alarm condition indicating tones are executed thereby.

58. An electrical unit as in claim 54 which includes a settable location specifying element and wherein the voice output circuitry, when driven by the control circuit verbally produces a location specifying message, in accordance with a setting of the location specifying element in some of the first intervals which would otherwise be silent, provided, that the coded system specific identifier matches any received system identifier.

59. An electrical unit comprising:

at least one of a condition sensor and a source of illumination;

a control circuit responsive to a selected ambient condition to produce at least one output signal indicative thereof;

an audible output device, coupled to the control circuit and drivable thereby in response to the selected condition, to produce groups of user unalterable, alarm type indicating tones wherein groups of tones are spaced apart a first interval and wherein tones in a group are spaced apart from one another a second, shorter interval;

voice output circuitry, coupled to the control circuit and driven thereby to produce at least one user unalterable output message which verbally identifies an alarm location wherein the output message is injected into at least some of the first intervals between tonal groups;

a settable system specifying element coupled to the control circuit for establishing a coded system specific identifier; and at least one of a transmitter and a receiver coupled to the control circuitry to respectively send or receive a wireless signal indicative of the condition wherein sent signals include a system identifier and wherein received signals include a system identifier.

* * * * *